US007845591B2

(12) United States Patent
Murphy

(10) Patent No.: US 7,845,591 B2
(45) Date of Patent: Dec. 7, 2010

(54) WRAP ADAPTOR FOR WINDING KNEE WRAPS FOR POWER-LIFTING PURPOSES

(76) Inventor: Jason Murphy, 3764 Broadway, Grove City, OH (US) 43123

( * ) Notice: Subject to any disclaimer, the term of this patent is extended or adjusted under 35 U.S.C. 154(b) by 0 days.

(21) Appl. No.: 12/614,658

(22) Filed: Nov. 9, 2009

(65) Prior Publication Data

US 2010/0051735 A1 Mar. 4, 2010

Related U.S. Application Data

(63) Continuation of application No. 11/335,285, filed on Jan. 19, 2006, now abandoned.

(51) Int. Cl.
*B65H 19/28* (2006.01)

(52) U.S. Cl. ..... 242/532; 242/532.6; 242/587

(58) Field of Classification Search ..... 242/532, 242/532.6, 587, 404.2
See application file for complete search history.

(56) References Cited

U.S. PATENT DOCUMENTS 3,516,618 A * 6/1970 Reinke ..... 242/419.4
4,161,298 A * 7/1979 Davis ..... 242/530.3
5,524,843 A * 6/1996 McCauley ..... 242/532.6
5,533,689 A * 7/1996 Chalfant ..... 242/532.5
5,961,061 A * 10/1999 Stanley ..... 242/395
6,286,779 B1 * 9/2001 Devine ..... 242/532
7,374,124 B2 * 5/2008 Engelsher ..... 242/390.8
2003/0218090 A1 11/2003 Stith

FOREIGN PATENT DOCUMENTS

WO WO 2005060502 A2 * 7/2005

* cited by examiner

*Primary Examiner*—Sang Kim
(74) *Attorney, Agent, or Firm*—Jason H. Foster; Kremblas & Foster

(57) ABSTRACT

A wrap adaptor is provided which includes a Shaft, an L shaped retainer bar inserted into and welded to the Shaft, a Selector Pin, Foot Plate, and mean for winding and removing knee wrap from wrap adaptor shaft. The Shaft is inserted into a drill, and a knee wrap is inserted under the L shaped retainer bar, the drill is powered causing the knee wrap to become wound with tension; The Foot Plate is used to insert the Shaft with tightly wound knee wrap into foot plate with the Selector Pin inserted into Shaft forming a T handle to allow for removal of the wound knee wrap by pulling up on wrap adaptor shaft, for purpose of removing knee wrap from wrap adaptor shaft.

9 Claims, 3 Drawing Sheets

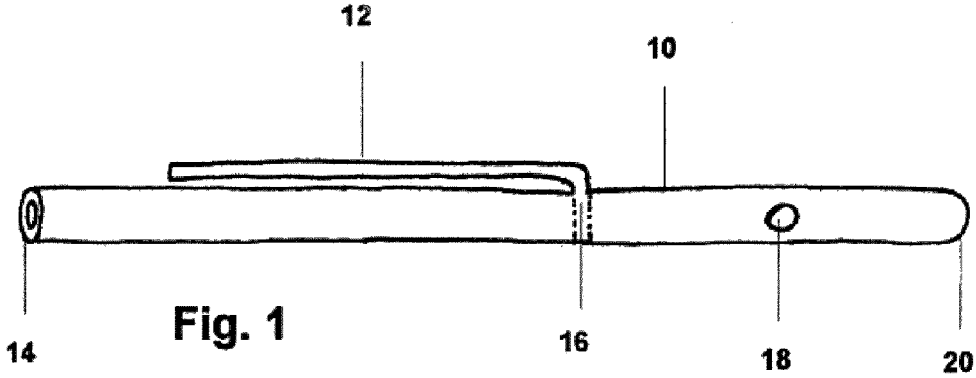
Fig. 1
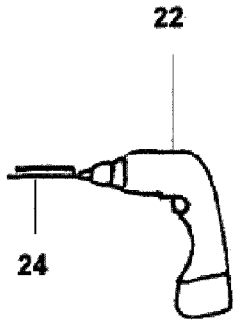
Fig. 1A
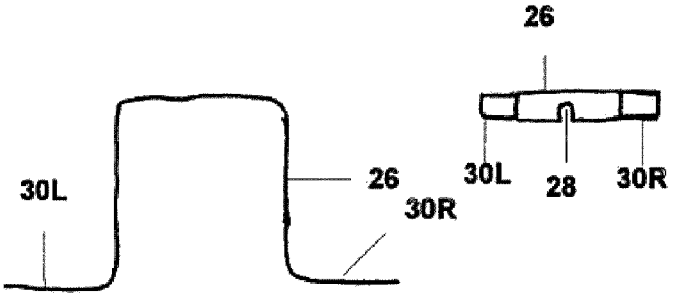
Fig. 2
Fig. 2A

WRAP ADAPTOR FOR WINDING KNEE WRAPS FOR POWER-LIFTING PURPOSES

CROSS-REFERENCES TO RELATED APPLICATIONS

This application is a continuation of U.S. application Ser. No. 11/335,285 filed Jan. 19, 2006, which claims the benefit of U.S. Provisional Application Ser. No. 60/646,129, filed Jan. 21, 2005. These applications are hereby incorporated by reference.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

In power lifting, athletes lift tremendous amounts of weight, often in excess of 1,000 pounds. When an athlete is engaged in this rigorous activity, they place a tremendous amount of stress on their joints, and too much weight, or excess stress, can put the athlete at risk. To minimize this risk, many athletes wrap pre-tensioned knee wraps around their knees for added support. The problem with pre-tensioned knee wraps is that the tighter they are wound, the tighter they can be wrapped around the knees. It is difficult to consistently wrap and re-wrap knee wraps with the needed tension. Athletes lifting over 1,000 pounds need every bit of energy they can muster, and the painful process of manually rolling wraps by hand requires the athlete to expend valuable energy, and results in fatigue and tremendous pain to the athletes' forearms.

2. Description of the Related Art

Another invention has attempted to solve this problem, but their inventions do not offer the same solution or functionality that the present invention (wrap adaptor) solves. U.S. Patent Application Publication No. 2003/0218090 to David A. Stith titled "Power Wrap Roller" (U.S. patent application Ser. No. 10/372,046) uses a larger separate stand alone device that uses multiple rollers to wrap the knee wraps. This device is bulkier, larger, and does not offer the portability that is offered by the wrap adaptor.

BRIEF SUMMARY OF THE INVENTION

The present invention eliminates the fatigue and strength sapping effort that power-lifters expend in manually rolling knee wraps, by providing an apparatus and method that requires very little effort. The present invention allows the power lifter to roll knee wraps with optimal tension without expending a lot of energy, or requiring the use of bulky equipment.

BRIEF DESCRIPTION OF THE SEVERAL VIEWS OF THE DRAWINGS

FIG. 1 is a frontal side close up detailed view of wrap adaptor shaft with dimensions of wrap adaptor shaft, and various component parts that make up the wrap adaptor design.

FIG. 1A is a view of the wrap adaptor shaft as it appears when inserted into the chuck of a drill.

FIG. 2 is a side schematic view of the foot plate used to aid in removal of knee wrap.

FIG. 2A is a close up top view of the foot plate with dimensions of slot used to insert wrap adaptor shaft into foot plate.

Figure 3:
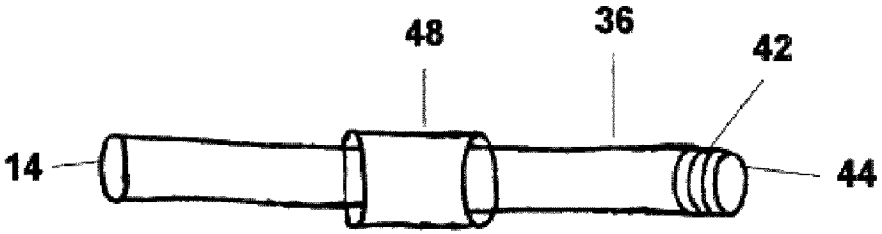
FIG. 3 is a close up side view of the selector pin.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Drawing

Reference Numerals

10—⅜" by 6½" rounded steel shaft;
12—⅛" by 3" steel L-shaped retainer bar;
14—¼" by 3" front center bored hole, hole #1;
16—Hole drilled through wrap adaptor main shaft that is used to welded l-shaped retainer bar to wrap adaptor main shaft;
18—¼" hole that serves as selector pin insertion point, hole #2;
20—Wrap adaptor drill insertion point;
22—Drill;
24—Wrap adaptor with all attached component parts;
26—Foot plate;
28—⅝" by 1¼" deep wrap adaptor insertion point;
30L—Left foot platform;
30R—Right foot platform;
34—Knee wrap;
36—¼" selector pin;
38—Knee wrap insertion point under retainer bar on wrap adaptor;
40—Rubber band placed around wrap after being wound;
42—Threaded end of selector pin used to screw selector pin into wrap adaptor shaft;
44—selector pin wrap adaptor insertion point;

46—Threaded inner chamber ¼" by 3" center bored hole of wrap adaptor shaft; and

48—Selector pin wrap adaptor connector.

FIG. 1 is a horizontal view of the wrap adaptor shaft 10 as it would appear prior to being inserted into a drill. The wrap adaptor shaft 10 front end has a ¼" by 3" deep center-bored hole 14 in main shaft. Inside the front end of the main shaft is a grooved insert for the ¼" selector pin 36 to be inserted, screwed into place, to operate as pivoting handle during the wrap winding process, or stored while the wrap adaptor is inactive (See FIGS. 3, 3A, 3B). Two holes are drilled into the wrap adaptor's main shaft 10, one at reference numeral 16 and another at reference numeral 18. The hole 16 is used to insert and weld the L-shaped ⅛" by 3" retainer bar 12 into the hole 16. The hole 18 is used to insert ¼" selector pin 36 into (see FIG. 4*b*) to form a T-bar handle used in removal of a wrap from the wrap adaptor shaft (see FIG. 4B). The drill insertion point 20 is then locked into place in the drill (See FIG. 1A) chuck.

Figure 4A:
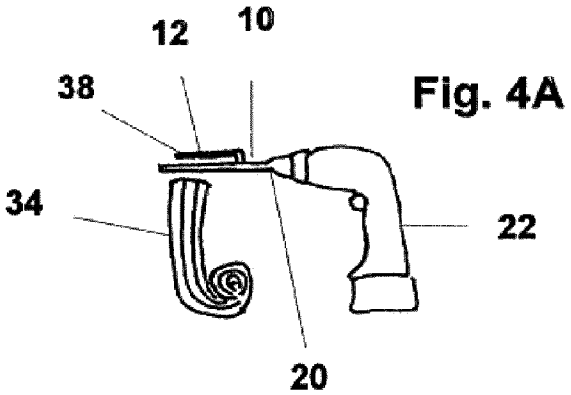
FIG. 4A is a detailed view of the wrap adaptor shaft with location where knee wrap is inserted under retainer bar, as it would appear when the shaft is inserted into a drill prior to the wrap being wound.
Figure 4B:
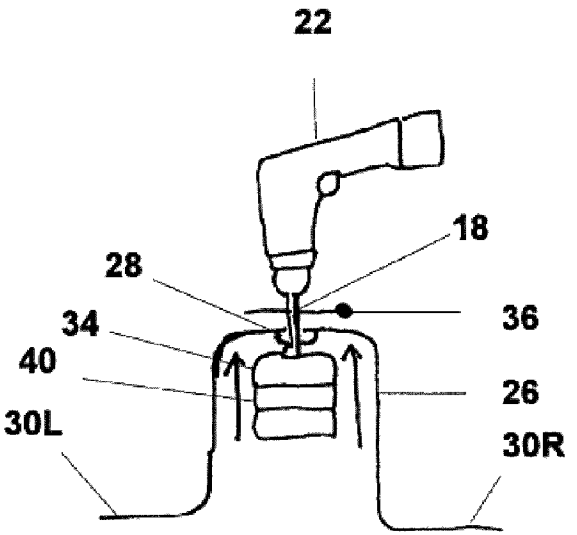
FIG. 4B is a detailed view of the wrap adaptor shaft inserted into the slot at the top of the foot plate with the selector pin forming a T-handle, after the knee wrap has been wound with tension, and a rubber-band is placed around the wrap to keep it wound.

FIGS. 2 and 2A are side and top views, respectively, of the foot plate 26 used to remove knee wrap 34 from wrap adaptor shaft (see FIG. 4B). The foot plate 26 is a rectangular shaped design with a ⅝" wide by 1¼" deep round opening at the top at reference numeral 28. Each side of the rectangular shaped foot plate 26 is 6" in length by 2" in width with the top surface measuring 4" in length by 2" in width. The bottom of the design is left open with two 4" by 2" platforms (30L and 30R) extending from the bottom of each side wall of the foot plate 26 that are used to balance foot plate 26 during removal of knee wrap 34 (see FIG. 4B).

Figure 3A:
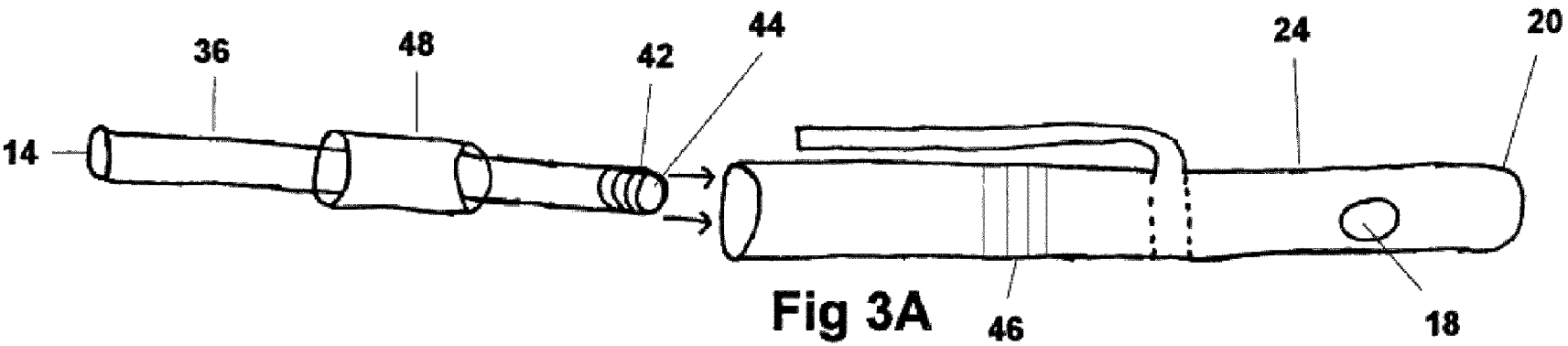
FIG. 3A is a side view of the selector pin before being screwed into place in the ¼" by 3" front center bored hole in the front of the wrap adaptor shaft.

FIGS. 3 and 3A are close-up side views of selector pin 36 and selector pin components, such as the threaded end 42, insertion point 44, threaded inner chamber 46, and the connector 48. The selector pin 36 can be inserted into the wrap adaptor shaft 10. The selector pin 36 with threaded end 42 is screwed into front center bored hole 14 in wrap adaptor shaft 10 by inserting the selector pin insertion point 44 into the front center bored hole of wrap adaptor shaft 10. The selector pin is inserted into front center bored hole 14 and is screwed into place inside wrap adaptor shaft 10, with the selector pin connector 48 forming a bond with the front end of the wrap adaptor shaft 10.

Figure 3B:
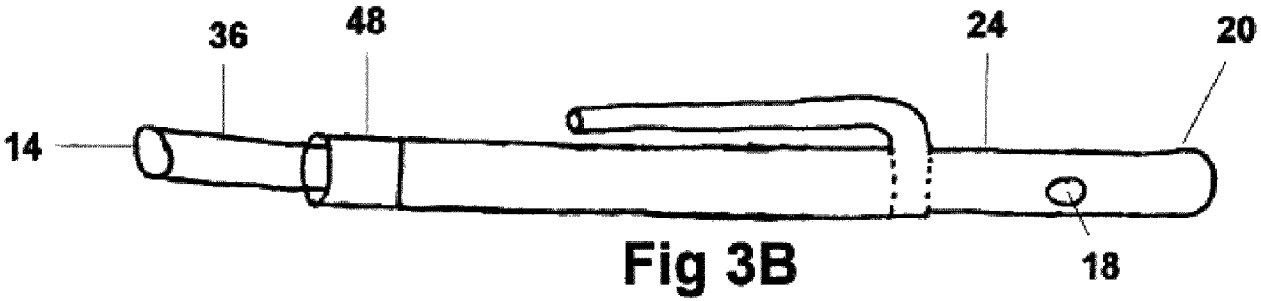
FIG. 3B is a side view of the selector pin when it is secured in the front center bored hole in the front of the wrap adaptor shaft, used with a pivoting handle during a wrap rolling process, and where selector pin is stored when wrap adaptor is not in use.

FIG. 3B is close up view of the selector pin 36 as it appears when attached to and screwed into wrap adaptor shaft 10 front center bored hole 14. The attachment position allows the selector pin to be used as pivotal handle during wrap rolling process, or as a storage location for selector pin 36.

Figure 4:
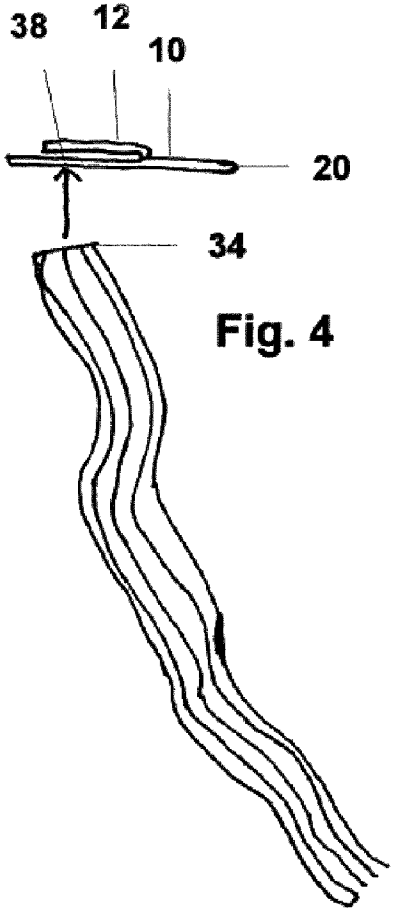
FIG. 4 is a detailed view of where a knee wrap band is inserted under the retainer bar on the wrap adaptor shaft.

FIGS. 4 and 4A are views of the knee wrap 34 being inserted under retainer bar 12 that is welded onto the wrap adaptor shaft 10. The wrap adaptor drill insertion point 20 is then inserted into drill chuck 20 (see FIG. 4A). The drill 22 is then powered to wind the knee wrap 34 around the wrap adaptor shaft, until tightly wound, at which point a rubber-band is placed around knee wrap 34 (see FIGS. 4A and 4B).

FIG. 4B is a view of the wrap adaptor 24 with the rolled, rubber-banded knee wrap attached thereto. The knee wrap is also positioned under the foot plate 26 at the top of the foot plate 26 with the knee wrap 34 inserted under opening 28. The wrap adaptor shaft is pulled upward against the top of the foot plate 26 using the selector pin 36 that operates as a T-handle to free the wound rubber-banded wrap from the wrap adaptor 24.

As shown in FIG. 1 and described briefly above, the wrap adaptor 24 is used to insert the knee wrap 34 under the welded retainer bar 12 with the wrap adaptor shaft drill insertion point 20 inserted into drill chuck and tightened (see FIGS. 4 and 4A). The drill 22 then spins the wrap adaptor shaft 10 with wrap 34 being tightly wound as the shaft spins until the knee wrap is completely wound (see FIG. 4B).

Once the knee wrap is wound, a rubber-band is placed around knee wrap, the power-lifter stands on the foot platforms 30L and 30R with the wrap adaptor shaft in a vertical position being inserted into the top opening 28 of the foot plate 26. The wrap adaptor shaft 24 with wrap 34 is then slid into the foot plate opening 28 with wrap 34 resting under the foot plate opening 28 (see FIG. 4B). The wrap adaptor shaft 10 is then pulled upward using the selector pin 36 that has been inserted into the selector pin insertion point 18 in the base of wrap adaptor shaft 10 (see FIG. 4B). The wrap adaptor shaft 24 is then pulled upward using the T-bar handle formed by inserting the selector pin 36 into the wrap adaptor selector insertion point 18 and pulling upward against top of foot plate 26 opening 28. The knee wrap 34 is then freed from wrap adaptor shaft 24, and the rubber band rolled knee wrap is then ready to be put away until used. This process can be repeated as many times as necessary.

The wrap adaptor shaft 24 is inserted into a drill with one end of the knee wrap 34 inserted under the retainer bar 12, while the operator steps on the other end of the knee wrap with their foot, supplying the required tension. The wrap adaptor is then rotated by powering the drill, which causes the knee wrap 34 to be wound tightly around the wrap adaptor 24. Once rolled, a rubber-band is placed around the knee wrap, the operator places the wrap adaptor with rolled rubber band wrap into a slot 28 at the top of the foot plate 26 with the operator inserting the selector pin 36 into the hole 18 at the base of the wrap adaptor shaft 24. Once the selector pin 36 is inserted into the wrap adaptor shaft 24, the operator pulls the wrap adaptor up against foot plate 26 using the T-bar handle formed by selector pin 36 inserted into the hole 18 at the base of the wrap adaptor shaft 24. Using the T-bar handle, the wrap adaptor 24 is pulled upward against top of foot plate 26 as described above, freeing the knee wrap 34 from the wrap adaptor shaft 24.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A knee wrap winding apparatus for wrapping a knee wrap, having a knee wrap thickness and a knee wrap width, tightly around itself in a roll, the apparatus comprising:

(a) a main shaft having an outer surface defining a drill insertion tip at a first shaft end and a hole formed in a second, opposite shaft end defining a barrel of a predetermined diameter that is substantially coaxial with an axis of the main shaft;

(b) a retaining pin rigidly mounted to the main shaft at a first pin end between the first shaft end and the second shaft end, the retaining pin having a second, opposite pin end extending away from the first pin end toward the second shaft end, wherein the retaining pin is spaced from the main shaft a distance at least as great as about the knee wrap thickness and the knee wrap is held between an outer surface of the retaining pin and the outer surface of the main shaft; and (c) a selector pin removably mounted in the barrel and rotates relative to the main shaft for allowing a user to grip the selector pin and stabilize the winding apparatus while the main shaft is rotated and the knee wrap is collected around the main shaft and the retaining pin, the selector pin having an outer diameter that is not substantially greater than the predetermined diameter of the barrel.

2. The apparatus in accordance with claim 1, further comprising a transverse hole formed in the main shaft for inserting the selector pin to form a T-shaped handle.

3. A knee wrap winding apparatus for winding a knee wrap tightly around itself in a roll, the apparatus comprising, in combination:

(a) a main shaft having an outer surface defining at a first shaft end a tool insertion tip and a hole formed in a second, opposite shaft end defining a barrel of a predetermined diameter that is substantially coaxial with an axis of the main shaft;

(b) a knee wrap having a knee wrap thickness, a first knee wrap end and a second, opposite knee wrap end;

(c) a retaining pin rigidly mounted to the main shaft at a first pin end between the first shaft end and the second shaft end, the retaining pin having a second, opposite pin end extending away from the first pin end toward the second shaft end, wherein a gap is formed between the retaining pin and the main shaft and the knee wrap is inserted in the gap near the first knee wrap end;

(d) a rotatably driven tool having a contractible chuck tightly gripping the tool insertion tip of the main shaft; and (e) a selector pin having an outer diameter that is not substantially greater than the predetermined diameter of the barrel removably mounted in the barrel and rotates relative to the barrel for allowing a user to grip the selector pin and stabilize the winding apparatus while the main shaft is rotated by the rotatably driven tool and the knee wrap is collected around the main shaft and the retaining pin.

4. The apparatus in accordance with claim 3, further comprising a transverse hole formed in the main shaft for inserting the selector pin to form a T-shaped handle.

5. A method of wrapping a knee wrap tightly around itself in a roll, the method comprising:

(a) inserting a first end of a knee wrap having a second, opposite knee wrap end in a gap formed between (i) a main shaft having an outer surface at one shaft end defining a tool insertion tip and a hole formed in a second, opposite shaft end defining a barrel of a predetermined diameter that is substantially coaxial with an axis of the main shaft; and (ii) a retaining pin rigidly mounted to the main shaft at a first pin end between the tool insertion tip and the hole, the retaining pin having a second, opposite pin end extending away from the first pin end toward the hole;

(b) gripping the tool insertion tip of the main shaft in a rotatably driven tool having a contractible chuck;

(c) removably mounting a selector pin, having an outer diameter that is not substantially greater than the predetermined diameter of the barrel, in the barrel;

(d) rotating the chuck of the tool, therein rotating the main shaft, to wind the knee wrap around the main shaft and the retaining pin; and (e) gripping the selector pin with a hand while simultaneously carrying out the step of rotating the chuck of the tool, therein forming a support for the selector pin end of the apparatus.

6. The method in accordance with claim 5, further comprising the steps of inserting the selector pin in a transverse hole formed in the main shaft to form a T-shaped handle, and then pulling on the T-shaped handle relative to the knee wrap.

7. The method in accordance with claim 5, further comprising the step of rotatably mounting the selector pin within the barrel.

8. The method in accordance with claim 7, further comprising the step of applying a force on the second end of the knee wrap while simultaneously carrying out the step of rotating the chuck of the tool, thereby maintaining tension on the knee wrap as the knee wrap is wound around the main shaft.

9. The method in accordance with claim 5, further comprising the steps of removing the selector pin from the barrel and then pulling the wrap off of the main shaft.

* * * * *